United States Patent [19]

Chang et al.

[11] Patent Number: 4,846,502

[45] Date of Patent: Jul. 11, 1989

[54] TAMPER EVIDENT DOCUMENT AND USE THEREOF

[75] Inventors: John C. H. Chang, Naperville; Theodore Dimitriou, Mettawa, both of Ill.

[73] Assignee: Wallace Computer Services, Inc., Hillside, Ill.

[21] Appl. No.: 877,760

[22] Filed: Jun. 24, 1986

[51] Int. Cl.[4] ..... B42D 15/00

[52] U.S. Cl. ..... 283/57; 282/9 R; 283/59; 283/94; 283/96; 283/95; 283/901

[58] Field of Search ..... 282/9 R, 9 A, 11.5 R, 282/11.5 A, 10, 11, 8 R; 283/58, 901, 57, 59, 94, 70, 95, 96, 114; 346/204, 206; 428/915, 916

[56] References Cited

U.S. PATENT DOCUMENTS

| | | | |
|---|---|---|---|
| 1,244,946 | 10/1917 | Bickford | 283/114 X |
| 1,368,518 | 2/1921 | Mayne . | |
| 1,727,912 | 9/1929 | Snyder . | |
| 1,817,171 | 8/1931 | Smith . | |
| 1,910,568 | 5/1933 | Snyder . | |
| 2,032,816 | 3/1936 | Smith . | |
| 2,065,605 | 12/1936 | Moore . | |
| 3,104,799 | 9/1963 | Steidinger . | |
| 3,802,724 | 4/1974 | Gosnell . | |
| 3,821,010 | 6/1974 | Vincent et al. . | |
| 3,954,803 | 5/1976 | Vincent et al. . | |
| 4,037,007 | 7/1977 | Wood | 283/95 X |
| 4,104,437 | 8/1978 | Vincent et al. . | |
| 4,143,891 | 3/1979 | Neubauer . | |
| 4,317,743 | 3/1983 | Chang . | |
| 4,360,548 | 11/1982 | Skees et al. | 428/29 |
| 4,425,386 | 1/1984 | Chang . | |
| 4,448,445 | 5/1984 | Chang et al. . | |
| 4,496,961 | 1/1985 | Devrient . | |
| 4,512,595 | 4/1985 | Breen | 283/95 X |
| 4,662,651 | 5/1987 | Mowry, Jr. | 283/70 |
| 4,681,348 | 7/1987 | Mowry, Jr. | 283/58 |

FOREIGN PATENT DOCUMENTS

| | | | |
|---|---|---|---|
| 2600781 | 5/1979 | Fed. Rep. of Germany . | |
| 110008 | 8/1979 | Japan . | |
| 434475 | 11/1933 | United Kingdom | 283/94 |
| 1197406 | 1/1970 | United Kingdom . | |

OTHER PUBLICATIONS (Anonymous) "Security Document"; *Research Disclosure*; No. 187, Nov. 1979, pp. 638, 639.

*Primary Examiner*—Paul A. Bell

*Attorney, Agent, or Firm*—Roylance, Abrams, Berdo & Goodman

[57] ABSTRACT

A tamper evident document comprising a support bearing an autogenous coating including chromogenic material isolated from an electron-acceptor color developer material in which the autogenous coating bears a principal image comprising visible indicia of a transfer medium imprinted on the surface of the localized autogenous coating. Tampering with the principal image causes chromogen to react with the electron-acceptor color developer material to provide a color indication of tampering. The tamper evident document can be part of a multi-ply record system comprising a plurality of sheets in superposed relationship, comprising a first sheet including a support bearing an autogenous coating including chromogenic material isolated from an electron-acceptor color developer material, said localized autogenous coating bearing a principle image comprising invisible indicia of a transfer medium imprinted on the surface of said localized autogenous coating, and a second sheet including a support bearing a coating of a transfer medium on the first side of said support, said second sheet being positioned adjacent said first sheet with said first side adjacent and in superposed relationship to said autogenous coating such that when pressure is applied to the second side of said second sheet transfer medium in the form of visible indicia is imprinted onto said autogenous coating, wherein tampering with said principal image causes chromogen to contact with said electron-acceptor color developer material to provide a color indication of tampering.

21 Claims, 2 Drawing Sheets

FIG.5
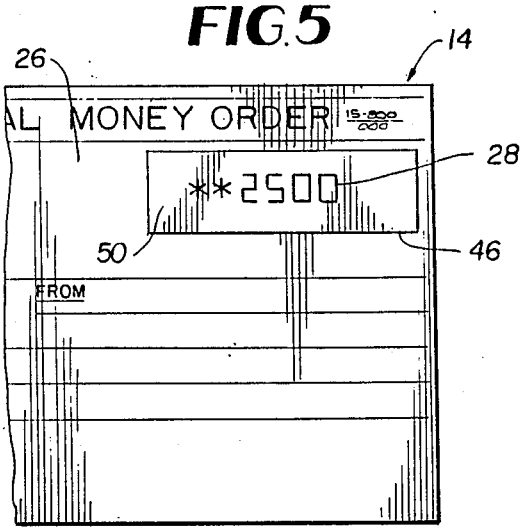
FIG.6
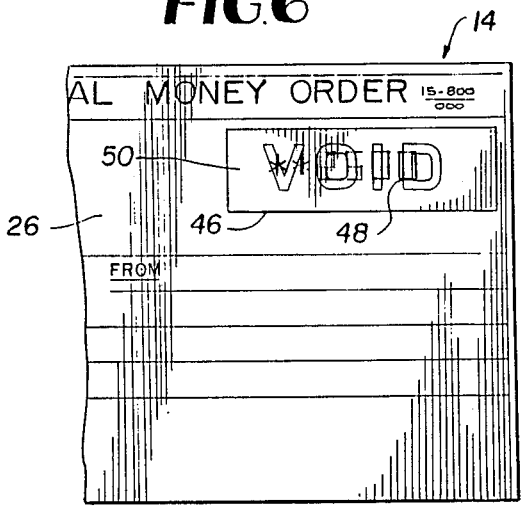
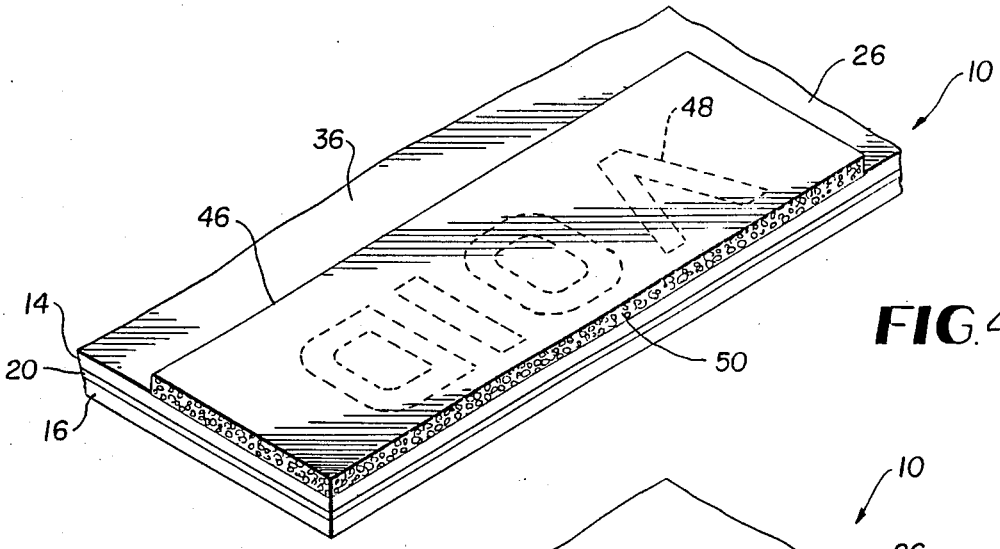
FIG.4
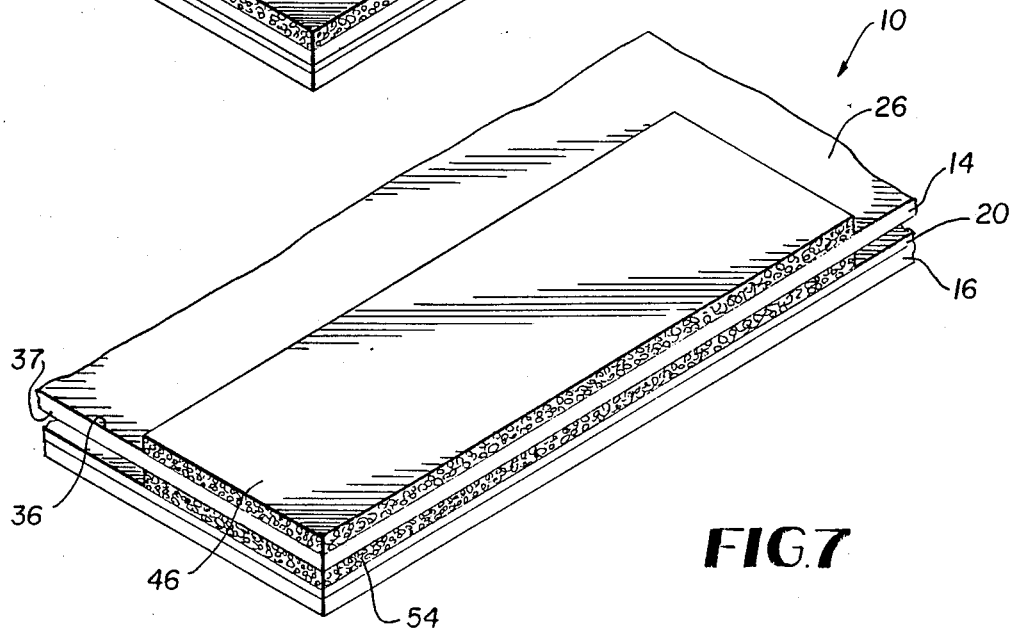
FIG.7

TAMPER EVIDENT DOCUMENT AND USE THEREOF

FIELD OF THE INVENTION

This invention relates to a tamper evident document, a tamper evident multi-ply record system for creating and safeguarding negotiable instruments, a tamper evident negotiable instrument, and to the use of such tamper evident documents. More particularly, this invention relates to tamper evident documents having autogenous coatings on which is imprinted transfer medium in the form of visible indicia.

BACKGROUND OF THE INVENTION

Important information is often provided on documents, such as negotiable instruments, by imprinting transfer media in the form of visible indicia onto the face of the instrument. A common transfer medium is carbon which is transferred from a sheet of carbon paper placed over the face of the instrument, or ink from an inked typewriter ribbon. The transfer medium is imprinted onto the face of the instrument by typing, hand writing, mechanical means, etc. Such imprinted visible indicia is often subjected to unauthorized alteration. The negotiable instrument may be a bank check, money order, bill of exchange, certificate of deposit, treasury check, cashier's check, traveler's check, letter of credit, warrant, airline ticket, contract, deed, securities certificates, identification card, etc. Illegal alterations cause financial loss to the issuers resulting in costly legal action.

Several illicit practices have been commonly used to alter such instruments. For visible indicia formed by transferable ribbon, a pressure-sensitive tape has been used to lift the images. For indicia formed by carbon paper, inked ribbon, and ink pens, a combination of an eraser and a sharp-edged object has been used to alter the numbers. For indicia formed by special inks, organic solvents have been used to alter such indicia. So far, no known system can counter such illicit alterations.

Thus, there has been a continuing need for a tamper evident system useful for negotiable instruments and other valuable documents.

SUMMARY OF THE INVENTION

A tamper evident system has now been discovered which can be used to prevent illicit alternation of documents including negotiable instruments, which system comprises a support bearing an autogenous coating comprising a chromogenic material isolated from an electron-acceptor color developer material, said autogenous coating adapted to receive a principal image comprising visible indicia of a transfer medium which is imprinted on the surface of the autogenous coating, said autogenous coating being at least generally coextensive with said principal image, such that tampering with the principal image releases chromogen from the capsules to contact and react with the electron-acceptor color developer material and provide a visible indication of tampering. The visible indication of tampering can be by color contrast between the color of the principal image (e.g., black) and the developed color of the chromogen (e.g., yellow).

According to a preferred embodiment of the present invention, the chromogen is isolated from the electron acceptor material by providing the chromogen in microscopic pressure rupturable capsules. According to another preferred embodiment of the invention, the chromogen is isolated from the electron-acceptor color developer material by means of a barrier coating.

According to a further embodiment of the invention tampering is indicated by a message appearing when chromogen is released and reacts with the electron-acceptor color developer material. According to this embodiment of the present invention, the autogenous coating comprises a first layer comprising a latent image of a message, such as "VOID" formed of the electron-acceptor color developer material, and a second adjacent layer including chromogen-containing microscopic pressure rupturable capsules. Alternatively, the latent image can be printed using the chromogen in an ink base and coated with a barrier layer followed by a layer of Lewis acid electron-acceptor color developer to form the autogenous coating.

According to another embodiment of the present invention the tamper evident document of the present invention is a negotiable instrument where the principal image is a monetary amount, such as in the case of a money order. In such embodiment, the tamper evident document is contained in a multi-ply record system comprising a plurality of sheets in superposed relationship, comprising a first sheet including a support bearing an autogenous coating comprising a chromogenic material isolated from an electron-acceptor color developer material, said autogenous coating bearing visible indicia of a transfer medium imprinted on the surface of the autogenous coating as the principal image, said autogenous coating being at least generally coextensive with said principal image and, preferably, a localized coating generally coextensive with said principal image. A second sheet including a support bearing a coating of a transfer medium on the first side of the support with the second sheet being positioned adjacent the first sheet with the first side adjacent and in superposed relation to the autogenous coating, such that when pressure is applied to the second side of the second sheet, the transfer medium in the form of visible indicia will be imprinted onto the autogenous coating to form an imprinted visible indicia, which, if tampered with, will reveal a color indication of tampering in the areas the tampering occurred.

According to another preferred embodiment of the present invention, a second localized autogenous coating is provided on the surface of the support opposite and at least generally coextensive with the principal image. This not only permits the imprinting of a mirror image of the monetary amount, but can further reveal any tampering with the principal or mirror image.

According to a still further embodiment of the present invention, a method for the protection of imprinted documents, such as wills, is provided, which comprises providing a supporting bearing generally coextensive autogenous coatings on opposite sides of said support such that tampering with said printed indicia is revealed by release of said chromogen from said microscopic capsules to form a contrasting color in the areas of tampering.

As used in the present application, the term "principal image" is defined as a visible image of a transfer medium subject to alteration. The principal image can be a monetary amount in numerical ("$25.00") or written (twenty-five dollars") form on a negotiable instrument, such as a money order or check, which has been transferred to the surface of the autogenous coating, such as a carbon image from carbon paper or an ink image from an inked ribbon. Likewise, the principal image can be all or a portion of written material of valuable document, such as a will, which is subject to alteration. The principal image is contrasted from a secondary visible image, which is not subject to alteration. For example, on a postal money order, preprinted visible indicia, such as the words "money order" would not be subject to alteration and not be within the definition "principal image".

The expression "transfer medium" as used herein means a medium transferred as an image from one substrate to the surface of the autogenous coating; such as carbon from carbon paper, ink from an inked typewritter ribbon, ink from a ballpoint pen or the like.

BRIEF DESCRIPTION OF THE DRAWINGS

FIG. 4 is a partial, schematic and perspective view of the money order of FIG. 1 modified according to another embodiment of the invention.

FIG. 5 is a partial, top plan view of the untampered money order of FIG. 4 having imprinted visible indicia thereon.

FIG. 6 is a partial, top plan view of the money order of FIG. 4 after tampering.

FIG. 7 is a partial, schematic and perspective view of the money order of FIG. 1 modified according to another embodiment of the invention.

DETAILED DESCRIPTION OF THE PREFERRED EMBODIMENTS

Figure 1:
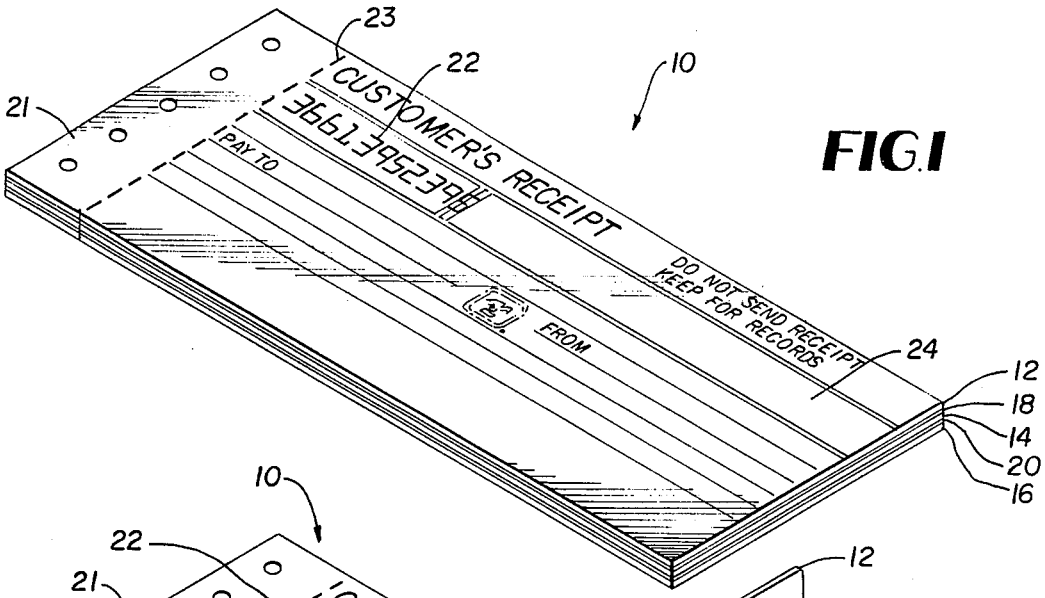
FIG. 1 is a schematic and perspective view of a postal money order.
Figure 2:
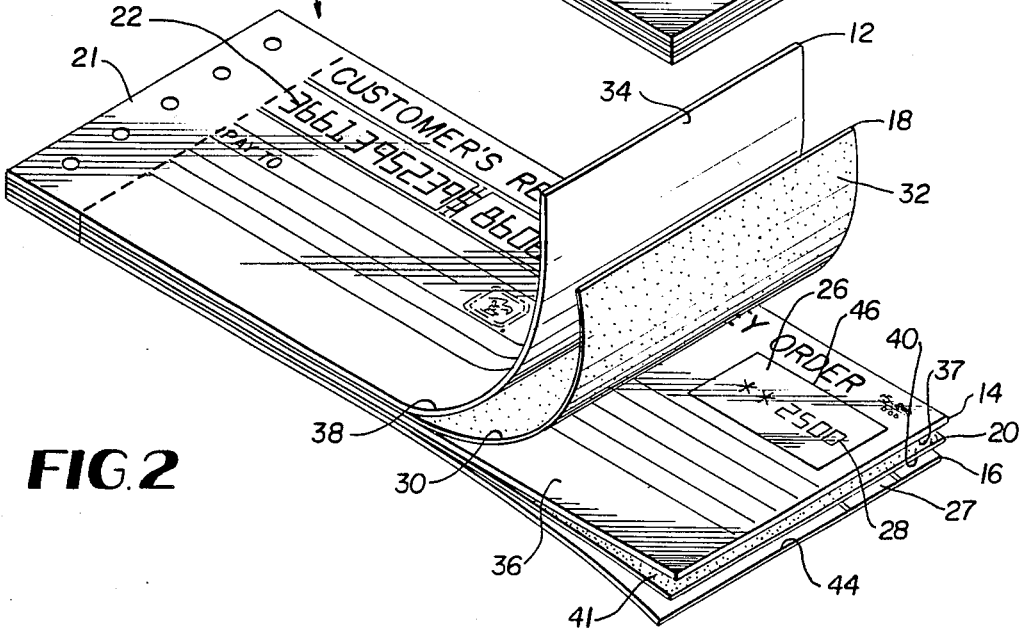
FIG. 2 is a schematic and perspective view of the a postal money order of FIG. 1 having imprinted visible negotiable indicia thereon.

FIGS. 1 and 2 illustrate a multi-ply record system 10 for creating a negotiable instrument, which is in this case a postal money order. The multi-ply record system 10 comprises a top record sheet 12, which serves as the customer's receipt, a middle record sheet 14, which serves as the negotiable instrument, and a bottom record sheet 16, which serves as the post office record of the transaction. Upper and lower transfer sheets 18 and 20, respectively, which are coated with a carbon transfer medium on one or both sides, are interposed between the top, middle and bottom record sheets 12, 14 and 16, and serve to transfer any visible indicia between the top, middle and bottom record sheets. The record sheets 12, 14 and 16, and the transfer sheets 18 and 20 are bound together in superposed relationship by binding 21, and are detachable along perforated line 23. Each of the record sheets 12, 14 and 16 in the record system 10 is provided with an identical preprinted serial number 22. The top record sheet 12 has an information area 24, which is filled in with specific information at the time the money order is issued. Such information includes the date, the amount of the money order, and a number identifying the post office branch issuing the money order.

In FIG. 2, the top record sheet 12 and top transfer sheet 18 have been partially lifted to reveal part of the middle record sheet 14, i.e. the negotiable instrument which is provided with an autogenous coating 46 hereinafter discussed in more detail in regard to FIG. 3. The middle and bottom record sheets 14 and 16 have information areas 26 and 27, respectively, corresponding to area 24 shown in FIG. 1. The information area 26 of sheet 14 has been provided with a transfer medium imprinted onto autogenous coating 46 in the form of visible indicia 28 indicating the amount of the money order, e.g. $2500. The expression "negotiable instrument" as used in this application means any instrument which can be exchanged for or represents a monetary amount or its equivalent, such as money orders, checks, credit card forms, etc.

When the postal money order is purchased, multi-ply record system 10 is placed onto an imprinter (not shown) comprising a lower plate having raised numeric indicia indicating the date, amount, and post office branch. A top plate or roller, such as those used for credit card purchases, is used to force the record system 10 downwardly against the raised numeric indicia on the lower plate. The downward force against the raised numeric indicia results in the imprinting of the transfer medium from transfer sheets 18 and 20 onto the record sheets 12, 14 and 16. The upper transfer sheet 18 has transfer medium coated on both its front side 30 and rear side 32 resulting in the imprinting of the transfer medium onto rear side 34 of the top record sheet 12, and the front side 36 of the middle record sheet 14. Because the top record sheet 12 is semi-translucent, the imprinted transfer medium on rear side 34 is visible from the front side 38. The rear side 40 of the lower transfer sheet 20 is completely coated with transfer medium so that all the information provided by the raised numeric indicia is imprinted onto the front side 44 of the bottom record sheet 16. The bottom record sheet 16 containing the imprinted visible indicia is then retained by the post office for its records.

The front side of the lower transfer sheet 20 contains a localized coating of transfer medium 41 so that only visible indicia indicating the amount of the money order purchased are imprinted onto the rear side 37 of the middle record sheet 14, i.e. the negotiable instrument. Thus, the middle record sheet 14 contains all of the numeric indicia in the information area 26 on the autogenous coating 46 on its front side 36, but only contains imprinted visible indicia indicating the amount of the money order purchased on rear side 37. Therefore, one would have to tamper with both the front side 36 and rear side 37 of the record sheet 14 in order to alter the amount of the money order.

The postal money order shown in FIGS. 1 and 2 is but one example of a multi-ply record system for creating negotiable instruments which can utilize the system of the present invention, and many other types of such systems exist. Generally, however, each such system has two common components. The first common component is a record sheet (e.g. middle record sheet 14) that becomes the negotiable instrument, and the second common component is a transfer sheet (e.g. upper transfer sheet 18) that is either completely or locally coated on at least one side with a transfer medium. When pressure is applied to the system and specifically to the transfer sheet, for example, by typing, writing, mechanical means, etc., transfer medium in the form of visible indicia (usually a dollar amount) is imprinted onto one side of the record sheet thereby creating the negotiable instrument. Mechanical means are often used so that the information imprinted on the record sheet is uniform and suitable for reading by computerized scanners. The information imprinted thereon can thus be quickly stored in a computer.

As previously mentioned, several physical and chemical techniques exist for undetectably tampering with the printed visible indicia so as to alter the amount of the negotiable instrument. Accordingly, the present invention as seen in FIGS. 3–7 provides a method for detecting tampering with the printed visible indicia of a transfer medium.

Figure 3:
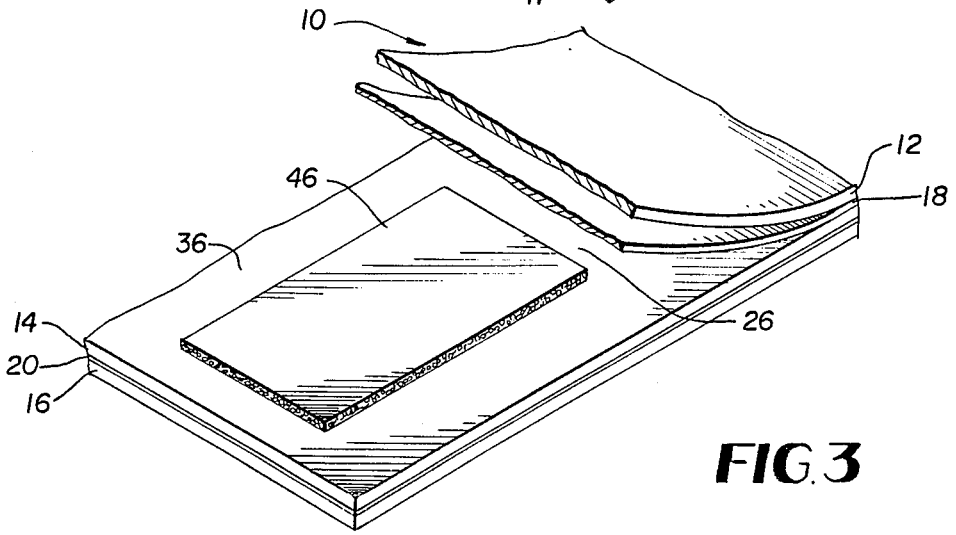
FIG. 3 is a partial, schematic and perspective view of the money order of FIG. 1 modified according to one embodiment of the invention.

As seen in FIG. 3, the invention basically comprises the addition of at least one localized autogenous coating 46 onto the record sheet 14 that serves as the negotiable instrument. The localized or spot coating of autogenous coating 46 is located over at least a portion of the information area 26 on the record sheet 14 so that at least the imprinted visible indicia of transfer medium indicating the dollar amount will be imprinted onto the localized autogenous coating 46. Of course, the autogenous coating can extend over the entire information area, and can be placed in other additional areas, such as the payee area, where tampering might take place, or may be coated over the entire substrate.

Autogenous coatings previously used in pressure-sensitive marking systems involve localized contact between a color forming chromogenic compound, such as crystal violet lactone, benzoyl leuco methylene blue, etc. and a complementary electron-acceptor color-developing material, such as a Lewis acid, to produce a colored marking on paper or the like which was the principal image. Generally, the colorless chromogenic substance is dissolved in minute oil droplets and encapsulated within the walls of pressure-rupturable microcapsules to prevent reaction between the chromogen and the color developer until the capsules are ruptured under the pressure of a writing or mechanical device to form a permanent record. However, in the system of the present invention, the autogenous coating is adapted to receive a principal image in the form of a transfer medium, and mark formation via the autogenous chromogen/color developer reaction is only to signal an illicit alteration of the principal image.

In the present autogenous or self-contained system, the electron-acceptor co-reactant and the chromogenic material are isolated from one another by any suitable means. Preferably the materials are isolated from one another by encapsulating the chromogenic material, so that the chromogenic material and electron accepting color developer material can be coated together to form an autogenous layer on the same substrate. Thus, when the substantially colorless chromogens are released from the microcapsules through leaching or rupture of the capsule wall, the chromogen instantly reacts with the electron-acceptor color developer material to form a distinct, visible color in situ.

Alternatively, the autogenous coating can be formed by isolating the chromogenic material from the electron accepting color developer material with an intermediate barrier coating. In this embodiment of the invention, the chromogenic material can be disposed, for example, in an ink base and coated onto the substrate. Thereafter a barrier layer is coated over the chromogen, and an electron acceptor material is thereafter coated over the barrier layer. Any suitable means can be used to isolate the chromogenic material from the electron acceptor color developer.

To have an eye catching result to signal an alteration, it is desirable for the autogenous coating to present a striking color contrast to that of the principal image. For example, if the dollar amount on the money order or a cashier's check is in black numerals, the color developed by the autogenous coating can be red, violet, orange, green, blue, or yellow to obtain a high degree of contrast. This can be achieved by encapsulating the appropriate chromogen in an oily solution of solvent. Suitable chromogens include, for example, crystal violet lactone, 2-dibenzylamino-6-diethylaminofluoran, rhodamine lactam, 2-methyl-6-diethylaminofluoran, 3,6-dimethoxyfluoran, and the like. Other appropriate color formers are disclosed in U.S. Pat. Nos. 3,821,010; 3,954,803; and 4,104,437 to Vincent and Chang, which are hereby incorporated by reference. However, if desired, the color produced by the chromogen can be the same as that of the principal image, since alteration of the principal image will still be revealed.

The microcapsules used to form the autogenous coating of the present invention are formed, for example, from coacervated gelatin, polycondensates from interfacial cross-linking, or hydrolyzed isocyanatoamidine product. Preferably, the microcapsules are formed by a microencapsulation process described in U.S. Pat. No. 4,317,743 to John C. H. Chang dated Mar. 2, 1982, the disclosure of which is hereby incorporated by reference.

The microcapsules may be of any suitable size, for example, and have an average diameter of between about 1 to about 20 microns, preferably, between about 3 to about 7 microns to avoid premature rupture. Likewise, a load bearing agent such as starch is added to the autogenous coating to help prevent premature rupture of the microcapsules. The amount of chromogen used is generally the amount needed to react with the Lewis acid in the autogenous layer, and may be present in amounts of, for example, from about 1 part by weight to about 15 parts by weight chromogen, preferably, from about 3 parts by weight to about 10 parts by weight chromogen per 100 parts by weight Lewis acid in the autogenous layer.

Preferred electron-acceptor materials for inclusion in the autogenous layer are the Lewis acids conventionally used to prepare carbonless copy papers. Preferred Lewis acids include, for example, alkylphenol-formaldehyde novolac resins, zinc salts of alkylsalicylic acids, acid activated clays, and the like.

Suitable barrier coating for isolating the chromogen from the Lewis acid color developer material include poly(vinyl alcohol), methylcellulose, hydroxyethylcellulose, styrene-butadiene latex, styrene-maleic anhydride copolymer, melamine-formaldehyde resin or the like.

Preferably, the autogenous layer additionally contains a color suppressant to prevent premature coloration. The color suppressant must be so chosen that it will not inhibit or adversely affect the color formation in the final product. Examples are ammonium hydroxide, alkanolamines, such as monoethanol amine, diethanolamine, N, N-dimethylethanolamine, and the like, condensates of amine-formaldehyde, such as urea-formaldehyde, melamine-formaldehyde, and the like. Suitable amounts of such color suppressants include from about 0.1 to about 10, preferably from about 0.5 to about 4 percent by weight based on the total dry weight of the coating composition. Other suitable color suppressants are disclosed, for example, in U.S. Pat. Nos. 4,010,292 and 4,170,483, which are hereby incorporated by reference. The autogenous coating preferably contains pigments such as calcium carbonate, titanium dioxide or clay to aid receptivity of the principal image, such as carbon or ink, onto the surface of the autogenous coating.

As previously indicated, the entire document can be coated with the autogenous coating if desired. However, it is preferred to use a localized or spot coating generally coextensive with the principal visible image are, such as the area on a check or money order where monetary information is inserted. Any suitable means may be utilized for applying a spot coating of the autogenous slurry, which comprises an admixture of microcapsules and Lewis acid material, to the negotiable instrument substrate. A preferred method of off-set gravure coating is disclosed in U.S. Pat. No. 4,425,386 to John C. H. Chang dated Jan. 10, 1984, which is hereby incorporated by reference.

As seen in FIG. 4, the autogenous coating 46 can comprise two or more coatings within the localized area. In FIG. 4 a substantially colorless ink-based Lewis acid 48 is first printed to form the word "VOID", or other alerting message to form a latent image as a first layer onto the information area 26. A second layer comprising chromogen-containing pressure rupturable microcapsules 50 are then coated over the Lewis acid-printed "VOID" to provide the image-forming autogenous coating system 46. Once the carbon or other transfer medium in the form of visible indicia is imprinted onto the autogenous coating 46, such as a monetary amount $2500, as in FIG. 5, subsequent tampering with the imprinted visible indicia, such as the use of an abrasive to alter the monetary amount, will release the chromogen from the microcapsules 50 to contact the Lewis acid 48, and the word "VOID" will become visible around the monetary amount as in FIG. 6 thereby indicating tampering.

Alternatively, the microcapsules can be applied first onto the substrate, according to the process described in the above-mentioned U.S. Pat. No. 4,425,386. The Lewis acid material is then coated or printed over the microcapsule coating. Likewise, the color former may be dissolved or dispersed in a vehicle such as a printing ink base, and the resulting solution can be printed on the substrate as a word, such as "VOID", a design or other revealing message. A barrier coat may be applied on top of the color former layer to prevent premature coloration. The Lewis acid is then coated or printed over the designated area.

Moreover, as illustrated in FIG. 7, an autogenous coating 54 can be additionally applied on the rear side of the middle record sheet 14 directly opposite and coextensive with the first coating 46, to provide a double protection. Any attempt to alter the imprinted visible indicia on the front side autogenous coating 46 will simultaneously form a warning color in both the front and rear coating 46 and 54, respectively. In fact, the rear side coating 54, because of its autogenous nature, develops the mirror image of the information when the monetary entry is initially made onto the front side coating 46.

Alternatively, as in the postal money order shown in FIGS. 1 and 2, a localized area of carbon transfer medium can be provided on the front side of the lower transfer sheet. The carbon transfer medium, which is adjacent to the rear side autogenous coating 54, provides a mirror image in the form of carbon transfer on the rear side autogenous coating 54. Regardless of how it is formed, the image on the rear coating 54 serves as in irrevocable reference. If it coincides with the front side image, it assures the authenticity of the negotiable instrument. On the other hand, if they differ due to forgery, it reveals that the original imprinted visible indicia have been disturbed. The autogenous coating 54 can be applied in any manner as previously described.

Other information, such as the name of the institution, title of the negotiable instrument, trademark, logogram, etc., may be printed over the autogenous coated area. Although the printing ink on an uncoated paper is very difficult to remove, it may be scraped off together with the autogenous coating when the information is altered with a sharp-edged object. Consequently, this leaves the negotiable instrument and document having insufficient information which can be easily identified as a forgery.

Once the transfer medium in the form of visible indicia are imprinted onto the autogenous coating on the negotiable instrument by means of an imprinter, typewriter, printer, manual inscription or other mechanical means, the autogenous coating underneath will protect the entry from being altered. Attempted lifting of the entry with a pressure-sensitive tape will rupture the microcapsules, and the released chromogenic material immediately reacts with the Lewis acid in the coating to show a warning color or alarming message. Erasing or mechanically removing the entry will also inevitably rupture the microcapsules to create a contrasting color background or alarming message. The use of organic solvents to dissolve the image will leach the chromogenic material from the microcapsules as well, causing instant coloration of the effected area. Heating can remove the image formed by the recent thermal transferable ribbon technology. However, the autogenous coating of this invention will turn colored up heating.

The invention will be further illustrated by the following examples. It should be understood that they are not intended to limit the scope of this invention.

EXAMPLE 1

Twenty grams of capsule slurry containing 0.35 gram of crystal violet lactone were made basic with 10 grams of ammonium hydroxide. Seventeen grams of melamine-formaldehyde condensate were mixed into the resulting slurry. Twenty grams of Keestar starch (commercially available from Ogilvie Mills, Inc.) and five grams of titanium dioxide were added, followed by the addition of twelve grams of a phenolic novolac resin dispersion at 50 percent solids. The resulting mixture was spot-coated on the face of a money order, using a two-roll gravure offset unit at a coat weight of about 2 pounds per 1,300 square feet of area.

The spot-coated money order was processed on an imprinter with a sheet of carbon paper. Dark black carbon images appeared. Attempts to alter the imprinted information resulted in creating a blue color background within the area.

EXAMPLE 2

Multiple printings of the work "VOID" was spot-printed with an ink-based phenolic novolac resin on a money order. The words were invisible to human eyes.

To ten dry grams of capsule slurry containing 0.35 gram of 7, 7'-bis (3-diethylaminofluoran) were added two dry grams of melamine-formaldehyde condensate, nine grams of Keestar starch, 3 grams of calcium carbonate available as Multifex MM, and a solution of two dry grams gelatin. The resulting slurry had a total solids content of 45 percent. The slurry was spot-coated over the area printed with phenolic novolac resin at a coat weight of about 1.4 pounds per 1,300 square feet of area.

Within the money order set, there is a ply of carbon coated paper directly facing the front side of the money order. When the spot-coated money order was processed on an imprinter, dark black images were formed. Attempted alteration of the imprinted information caused the word "VOID" to show up in brilliant red color.

What is claimed is:

1. A tamper evident document comprising a support bearing an information area comprising a first layer consisting essentially of chromogenic material and a second layer consisting essentially of an electron-acceptor color developer material, said first and second layers being in a superimposed relationship;

said information area bearing a visible principal image subject to alteration imprinted in the information area, said first and second layers being non-coextensive and the less extensive layer comprising a latent image of an alerting message non-coextensive with said visible principal image, said latent image being discontinuous under said visible principal image;

such that tampering with said principal image causes chromogen to contact said electron-acceptor color developer material, which in turn, causes latent image to become a visible, alerting message indicative of tampering.

2. The tamper evident document of claim 1 wherein the color developed by reaction between said chromogen and said color developer is different from and contrasts with the color of said principal image.

3. The tamper evident document of claim 1 wherein said document is a negotiable instrument and said principal image is a monetary amount.

4. The tamper evident document of claim 3 wherein said principal image comprises carbon transferred from a carbon transfer sheet.

5. The tamper evident document of claim 3 wherein said principal image comprises ink transferred from an inked ribbon.

6. The tamper evident document of claim 1 wherein a second localized autogenous coating is provided on the surface of said support opposite and at least generally coextensive with said principal image.

7. The tamper evident document of claim 6 wherein said second autogenous coating bears visible indicia of a transfer medium corresponding to a mirror image of said principal image.

8. The tamper evident document of claim 1 wherein said chromogenic material is isolated from said electron-acceptor color developer material by means of a barrier layer.

9. The tamper evident document of claim 1 wherein said chromogen is convertible to yellow, red, orange or green.

10. The tamper evident document of claim 1 wherein said less extensive layer comprises chromogenic material contained in pressure-rupturable microscopic capsules.

11. The tamper evident document of claim 1 wherein said less extensive layer comprises electronic-acceptor color developer material.

12. The tamper evident document of claim 1 wherein said layer comprising chromogenic material is isolated from said layer comprising color developer material by means of a barrier coating.

13. The tamper evident document of claim 1 wherein said principal image comprises visible indicia of a transfer medium.

14. The tamper evident document of claim 1 wherein said latent image of said alerting message comprises the word "VOID".

15. The tamper evident document of claim 1 wherein said latent image comprises separate alphabetic letters.

16. The tamper evident document of claim 1 wherein said latent image forms the word "VOID".

17. The tamper evident document of claim 16 wherein the information area bears the single word "VOID" formed by the said latent image.

18. A tamper evident document comprising a support bearing an information area comprising a first layer consisting essentially of chromogenic material and a second layer consisting essentially of an electron-acceptor color developer material, said first and second layers being in a superimposed relationship;

said information area bearing a visible principal image subject to alteration imprinted in the information area, said first and second layers being non-coextensive and the less extensive layer comprises a latent image of an alerting message of at least one character non-coextensive with said visible principal image, said latent image being discontinuous under said visible principal image;

such that tampering with said principal image causes chromogen to contact said electron-acceptor color developer material, which in turn, causes said latent image to become a visible, alerting message indicative of tampering and revealing at least a portion of the outline of a visible character.

19. The tamper evident document of claim 18 wherein the information area bears the single word "VOID" formed by the said latent image.

20. A tamper evident document comprising a support bearing an information area comprising a layer with of chromogenic material and with an electron-acceptor color developer material;

said information area bearing a visible principal image subject to alteration imprinted in the information area, said layer being non-coextensive and less extensive than the information area and comprising a latent image of an alerting message of at least one character non-coextensive with said visible principal image, said latent image being discontinuous under said visible principal image;

such that tampering with said principal image causes chromogen to contact said electron-acceptor color developer material, which in turn, causes the latent image to become a visible, alerting message indicative of tampering and revealing at least a portion of the outline of a visible character.

21. The tamper evident document of claim 20 wherein the information area bears the single word "VOID" formed by the said latent image.

* * * * *